US005678699A

United States Patent [19]

Gebka

[11] Patent Number: 5,678,699

[45] Date of Patent: Oct. 21, 1997

[54] STRIP MERCHANDISER HANGER AND LABEL HOLDER

[75] Inventor: John Gebka, Coral Springs, Fla.

[73] Assignee: Fast Industries, Inc., Ft. Lauderdale, Fla.

[21] Appl. No.: 682,180

[22] Filed: Jul. 17, 1996

Related U.S. Application Data

[63] Continuation-in-part of Ser. No. 630,832, Apr. 10, 1996.

[51] Int. Cl.[6] ..... A47F 5/00

[52] U.S. Cl. ..... 211/57.1; 211/73; 211/113; 211/118; 248/304; 40/642; 40/666

[58] Field of Search ..... 248/220.41, 220.43, 248/222.51, 304; 40/658, 666, 642; 211/113, 118, 57.1, 73

[56] References Cited

U.S. PATENT DOCUMENTS

| | | | |
|---|---|---|---|
| 4,476,983 | 10/1984 | Fast | 211/57.1 |
| 4,483,502 | 11/1984 | Fast | 248/223.41 |
| 4,497,464 | 2/1985 | Fast | 248/220.31 |
| 4,546,943 | 10/1985 | Fast | 211/57.1 |
| 4,718,627 | 1/1988 | Fast et al. | 211/113 |
| 4,767,012 | 8/1988 | Simmons | 211/71 |
| 4,911,392 | 3/1990 | Fast | 248/220.31 |
| 5,346,166 | 9/1994 | Valiulis | 248/220.41 |
| 5,386,916 | 2/1995 | Valiulis | 211/113 |
| 5,415,370 | 5/1995 | Valiulis | 248/220.41 |

OTHER PUBLICATIONS

Graphex Incorporated Advertisement entitled "Twin Hook Clip Strip & Sign Extender", #072195.

Fast Industries, Inc. Sell Sheet entitled "The Reversible Fold-A-Strip Sell Strip® Merchandiser".

Fasteners For Retail catalog entitled "1996 Buyers Guide", pp. 33, 43, 51–54.

*Primary Examiner*—Leslie A. Braun
*Assistant Examiner*—Donald J. Wallace
*Attorney, Agent, or Firm*—Jacobson, Price, Holman & Stern, PLLC

[57] ABSTRACT

A molded plastic display device adapted to be removably secured to a generally horizontally extending shelf perpendicularly to the front edge thereof, with a central upstanding label holder, both surfaces of which can be provided with merchandising indicia. A transparent label cover enables the label holder to carry adhesive or non-adhesive labels or signs. A pair of spaced hooks are provided below each label-receiving surface to support, in depending fashion, strip merchandisers carrying a multiplicity of products. Depending upon the width of the products being carried by the strip merchandisers, they may be selectively hung from whichever hook is closest to the shelf to minimize projection of the products into the aisle. The display device includes a simple foot and post mounting arrangement that provides secure cantilevered support even for a pair of fully loaded strip merchandisers, while permitting installation in only a single fashion so as to minimize the likelihood that inexperienced users will improperly install the display device on the shelf. The device may be provided with an attachable/detachable adaptor enabling the device to be used with shelves having different front edge surface configurations.

12 Claims, 5 Drawing Sheets

STRIP MERCHANDISER HANGER AND LABEL HOLDER

CROSS-REFERENCE TO RELATED APPLICATION

This application is a continuation in part of application Ser. No. 08/630,832 pending filed Apr. 10, 1996.

BACKGROUND OF THE INVENTION

1. Field of the Invention

This invention relates to a display device, and relates more particularly to a combination hanger for suspending a pair of strip merchandisers and a label holder for displaying information related to the products carried by the strip merchandisers. The display device of this invention is adapted to be removably secured to a generally horizontally extending shelf perpendicularly to the front edge thereof, with a central upstanding label holder, both surfaces of which can also be provided with merchandising indicia. Preferably, a pair of spaced hooks are provided below each label-receiving surface to support, in depending fashion, strip merchandisers carrying a multiplicity of products. In this manner, the merchandising indicia and the products carried by the strip merchandisers are visibly presented to customers passing in both directions along an aisle between rows of parallel shelves such as may be found in a supermarket or the like.

2. Description of Related Art

Small products such as packages of snack foods, e.g., potato chips or pretzels, or blister packs of batteries, one-drop room deodorizers and the like are commonly displayed forwardly of the front edge of a horizontally extending shelf in a store such as a supermarket, with the shelves themselves being used to support other products. In some instances, such products are suspended, in overlapping fashion, on hook-like members such as J-hooks or the like, or, in partially overlapping fashion, on elongated strips such as the clip strip shown in Fast U.S. Pat. No. 4,476,983 or other forms of strip merchandisers such as seen, for example, in Fast U.S. Pat. Nos. 4,483,502, 4,546,943 and 4,718,627.

The instant inventive concepts are particularly directed to the provision of a display device for, inter alia, supporting strip merchandisers, such as those disclosed in the aforementioned Fast patents, although shortened versions of such merchandisers, such as shown in Fast U.S. Pat. No. 4,911,392, which are more like a modified J-hook, can also be conveniently carried by the hanger of the instant invention. The disclosure of all of the Fast patents referred to above are incorporated herein in their entirety by reference.

Heretofore, such strip merchandisers have been supported by the shelf in depending fashion with the products carried thereby and any label associated therewith oriented generally parallel to the front edge of the shelf, limiting their visibility to customers passing through the aisle parallel to the array of shelves on either side. More recently, hangers have been proposed which are adapted to support strip merchandisers and/or product labels perpendicularly to the front edge of the shelves so as to face the flow of customers as they pass through the store aisles.

For example, Valiulis U.S. Pat. Nos. 5,386,916 and 5,415,370 each disclose a metal rod, one end of which is mounted in the apertures commonly formed in spaced rows through the upper surface of the shelf, with the opposite end cantilevered into the aisle. A hook is formed on the free end of the metal rod for receiving a strip merchandiser, and a plate is carried intermediate the rod ends for adhesively receiving a product label.

Valiulis U.S. Pat. No. 5,346,166 provides a modified hanger assembly wherein the metal rod has been replaced with a metal plate having a pair of depending wings, each of which is adapted to carry a strip merchandiser and a product label so that products and labels can be presented to customers passing in both directions down the aisle.

An integral molded plastic hanger adapted to support a pair of strip merchandisers facing in opposite directions, much like the modified Valiulis hanger assembly, with a groove adapted to receive and support a sign or the like, has been offered for sale by Graphex Incorporated of Exton, Pa.

The Valiulis hanger assemblies, being formed from metal, have obvious disadvantages, not the least of which is the relatively sharp edges associated with products of this nature, a defect particularly undesirable since such hangers are designed to extend into the aisle, sometimes at or about eye level of a passerby.

A problem associated with both the Graphex product and the Valiulis double hanger assembly is the manner in which these products are mounted on the merchandise shelf. The single Valiulis hanger assemblies are designed to utilize a single pair of front-to-back to-back aligned holes in the horizontally extending shelf surface. Both Valiulis and Graphex, when supporting a pair of strip merchandisers, provide mounting elements designed to engage a pair of laterally-spaced shelf apertures in the second row of apertures in the shelf surface. Not only does this arrangement somewhat reduce the surface available for supporting other products on the shelf, it is not uncommon for inexperienced users of such products to engage the mounting elements in holes in the first row of apertures in the shelf surface, projecting the hanger and the products supported thereby further into the aisle than is necessary, and significantly reducing the stability of the hanger device and its ability to effectively cantilever a pair of fully loaded strip merchandisers forwardly of the shelf.

Additionally, neither the Valiulis nor the Graphex products enable the presentation of significant merchandising information. The Valiulis hangers are designed to receive only small adhesive labels, while the Graphex groove can only support a relatively rigid cardboard or plastic sign. Neither device is versatile, nor can either device effectively display a simple non-adhesive paper label or the like.

SUMMARY OF THE INVENTION

It is therefore a primary object of the present invention to provide an integral plastic display device which orients multiple strip merchandisers and product labels generally perpendicularly to the front edge of a merchandise shelf in a simple, inexpensive and versatile manner.

An important object of this invention is to provide a display device for supporting multiple strip merchandisers, with an upstanding label holder adapted to receive and support both adhesive and non-adhesive labels or signs in a secure and efficient manner.

A further another object of this invention is the provision of an integral plastic display device, which includes a mounting portion adapted to rest on an inclined front edge surface of a shelf to maximize the cantilevered support for a pair of loaded strip merchandisers that are carried by the hanger assembly in spaced relationship to the front edge of the shelf.

Still another important object of this invention is the provision of a strip merchandiser hanger and label holder adapted to carry a pair of strip merchandisers, with the products supported thereby facing customers passing along the aisle from either direction, utilizing a simple foot and post mounting system which stabilizes the hanger, preventing sidewise twisting or rocking, maximizes the surface area available for supporting other products on the shelf, and can only be engaged with the shelf in a single manner so as to avoid improper installation by inexperienced users.

Yet another object of this invention is the provision of a display device of the type referred to including a pair of upstanding hooks on each side of its central axis, spaced from each other such that, depending on the width of the products carried by the strip merchandisers, the user can select a hook closest to the shelf to minimize projection of the strip merchandisers into the store aisle, thus reducing an injury risk to customers and personnel passing there along.

Still another object of the invention is to provide a display device as referred to which includes an attachable/detachable adaptor that enables the device to be used on shelves having different front edge surface configurations while providing effective cantilevered support for strip merchandisers in each case.

BRIEF DESCRIPTION OF THE DRAWINGS

The above and still further objects, features and advantages of the present invention will be readily understood or become apparent upon consideration of the following detailed description of the preferred embodiments hereof, especially when taken in conjunction with the accompanying drawings wherein.

DESCRIPTION OF THE PREFERRED EMBODIMENT(S)

Figure 6:
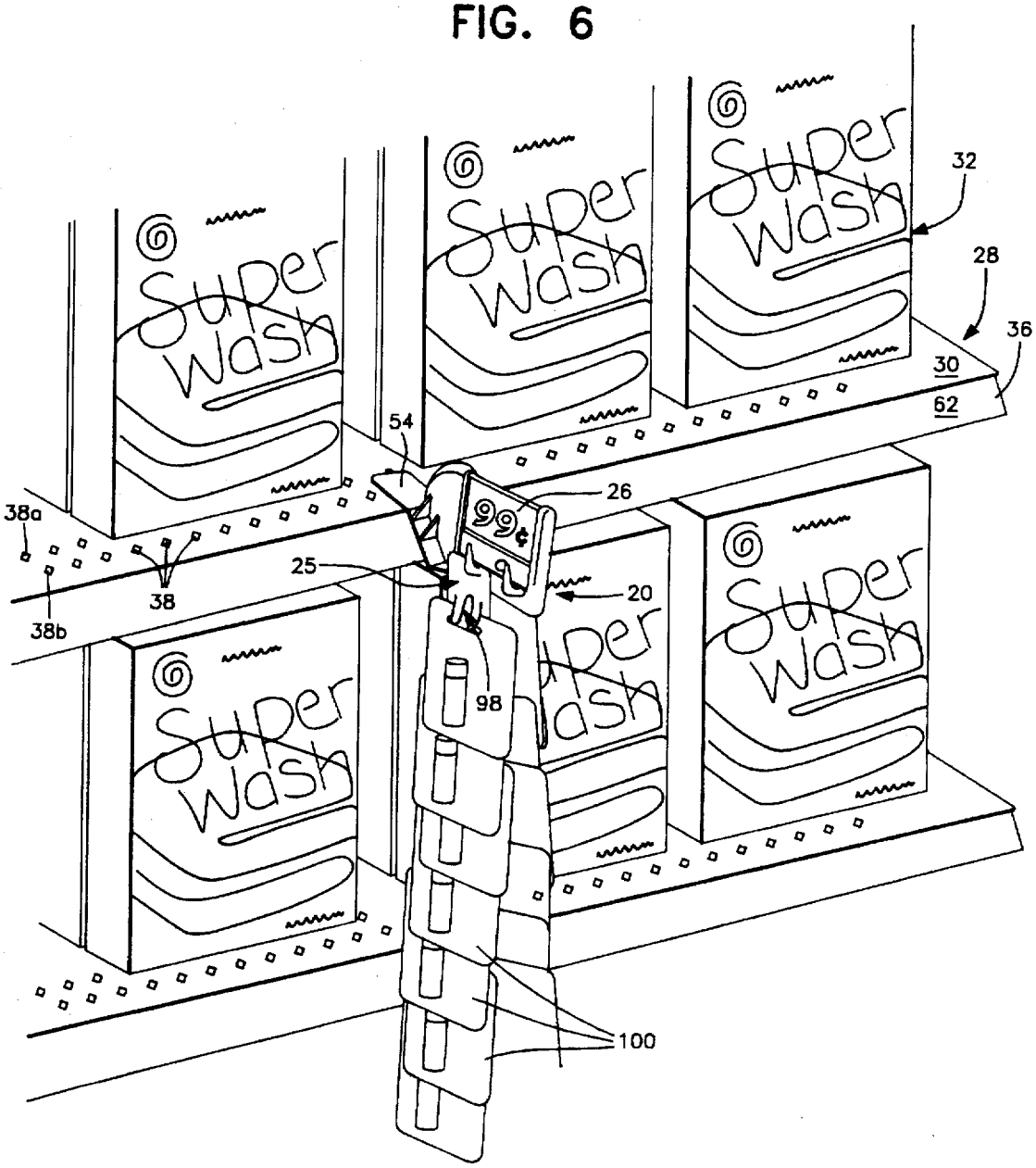
FIG. 6 is a perspective view of a strip merchandiser hanger and label holder according to this invention in use, supporting, on hooks closest to the shelf, a pair of strip merchandisers carrying a multiplicity of partially overlapped blister-carded products.
Figure 7:
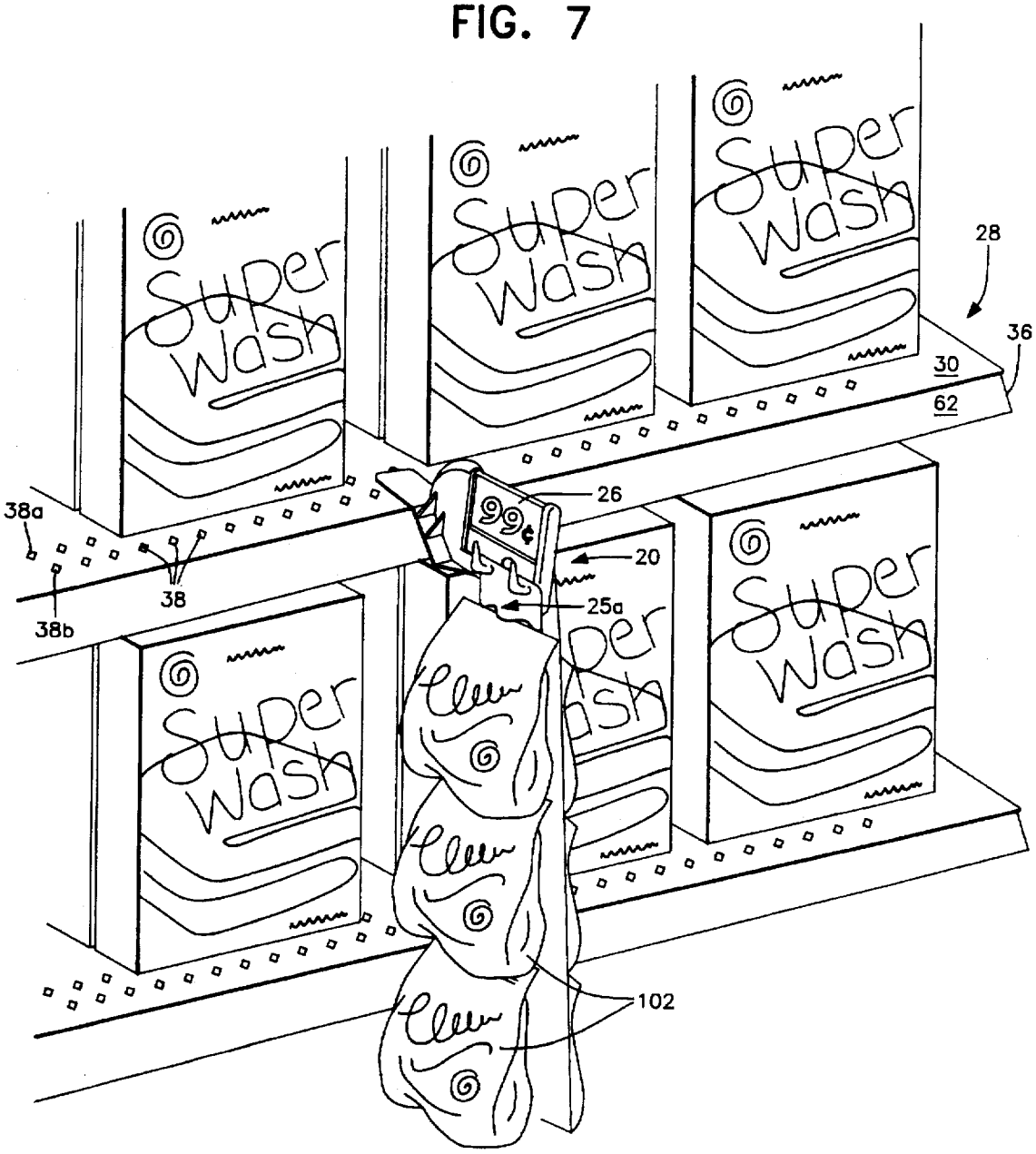
FIG. 7 is a view similar to FIG. 6, but showing strip merchandisers carrying under products supported on hooks farther from the shelf.

Referring now to the drawings, and particularly to FIGS. 1–7, an integral injection molded plastic display device according to this invention is designated generally by the reference numeral 20. The display device 20, as seen in FIGS. 6 and 7, is adapted to be mounted on a generally horizontally extending shelf 28, having an upper surface 30 for reception of products 32, a lower surface 34 and an elongated front edge flange 36. Commonly, shelves 28 includes a multiplicity of spaced apertures 38 extending therethrough in rows parallel to the front edge 36. The apertures 38 are shown as diamond-shaped, but oftentimes are round.

The display device 20 is generally symmetrical about an elongated central axis 44 and includes a mounting portion 46 covering approximately the rearward half of the device, and a supporting portion 48 covering approximately the forward half of the device. The mounting portion 46 is adapted to removably secure the display device 20 to the shelf 28 with the central axis 44 of the display device 20 perpendicular to the front edge 36 of the shelf 28.

The preferred mounting means, as shown in the drawings, is a simple foot 50 and post 52 arrangement. A base 54 includes a flat lower surface 56 adapted to rest on the forwardmost portion of the upper surface 30 of the shelf 28 and prevent rocking of the display device 20 from side-to-side. The foot 50, which is dimensioned to be received through an aperture **38*a* in the second row of apertures 38 in the shelf 28, extends centrally from the rearwardmost edge of the base 54 and is parallel to, and spaced below, the base 54 by a shoulder 58 slightly larger than the thickness of the shelf 28 between its upper and lower surfaces 30, 34, respectively. Thus, when the foot 50 is received through the aperture 38*a*, the upper surface 60 of the foot 50 engages against the lower surface 34 of the shelf 28 as seen particularly in FIG. 1**.

The post 52 depends from the lower surface 56 of the shelf 54, along the central axis 44 of the display device 20 forwardly of the foot 50. The post 52 is formed as a frusto-pyramid for reception in an aperture **38*b* in the first row of apertures 38 in the shelf 28, whether the aperture 38*b* is round or of a diamond configuration as shown. Engagement of the post 52 in the aperture 38*b* stabilizes the display device 20 and precludes the same from swivelling about the engagement of the foot 50 with the shelf 28. Failure to properly engage the foot 50 in an aperture 38*a* in the second row of apertures 38 will result in the post 52 engaging the upper surface 30 of the shelf 28 or the front surface 62 of the front edge flange 36 making it evident to even an unexperienced user that the display device 20** has been improperly installed.

If, as shown in the drawings, the front edge flange 36 of the shelf 28 includes a downwardly and outwardly extending front surface 62, the mounting portion 46 of the display device 20 further includes a transition member 64 extending between the forwardmost edge 66 of the base 54 and the rearwardmost edge of the supporting portion 48. The transition member 64 includes a lower surface 68 extending downwardly and outwardly from the lower surface 56 of the base 54 at the same angle as the front surface 62 of the front edge flange 36 of the shelf 28. By resting the lower surface 68 of the transition member 64 on the front surface 62 of the front edge flange 36 of the shelf 28, the cantilevered support for a pair of loaded strip merchandisers, to be carried by the supporting portion 48 of the display device 20 in spaced relationship to the front edge 36 of the shelf 28 as will be discussed in more detail hereinafter, is maximized.

A central flange 65 connects the mounting and supporting portions 46, 48 to increase the rigidity of the product and ribs such as shown at 67 may optionally be included if necessary to further strengthen the display device 20.

The supporting portion 48 of the display device 20 includes an upstanding label holder 70 extending along the central axis 44 and having an upper edge 72 and a depressed portion forming a label-receiving surface 74 on each side thereof. Each of the depressed label-receiving surfaces 74 are defined by a lower shoulder 76 and front and rear vertically extending flanges 78, 80 which, together, define guides to facilitate positioning an adhesive product label such as shown at 26 thereon.

Figure 1:
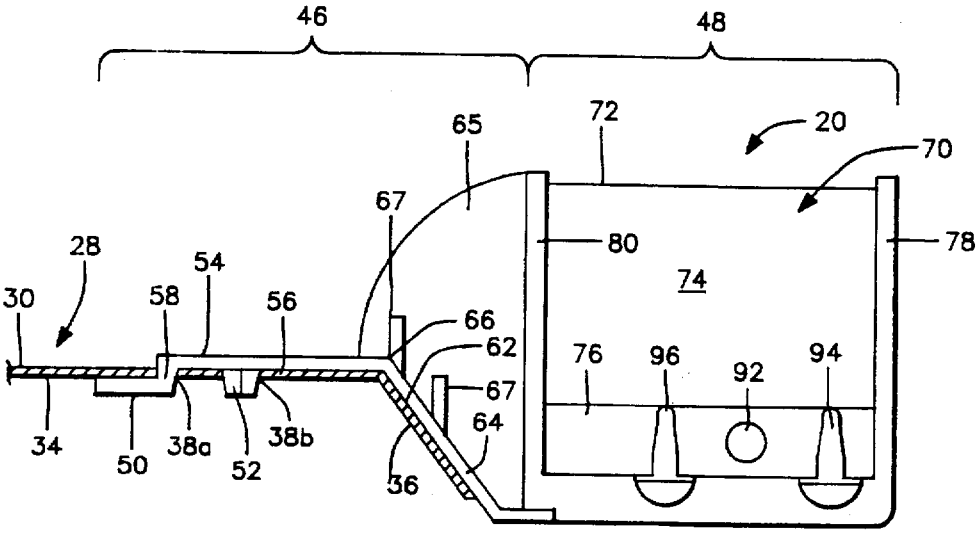
FIG. 1 is a side elevational view of a preferred embodiment of a display device in the nature of a strip merchandiser hanger and label holder according to the instant invention, with a fragmentary portion of a shelf being shown in cross-section for illustrative clarity.
Figure 10:
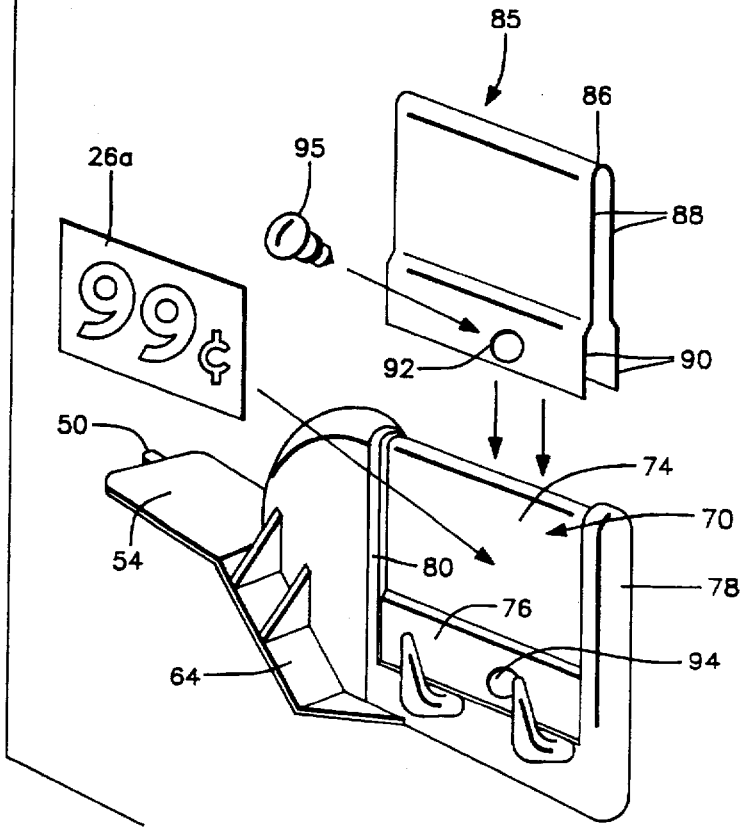
FIG. 10 is an exploded perspective view of the strip merchandiser hanger and label holder of the instant invention, showing the manner in which the label cover is associated therewith in use.
Figure 2:
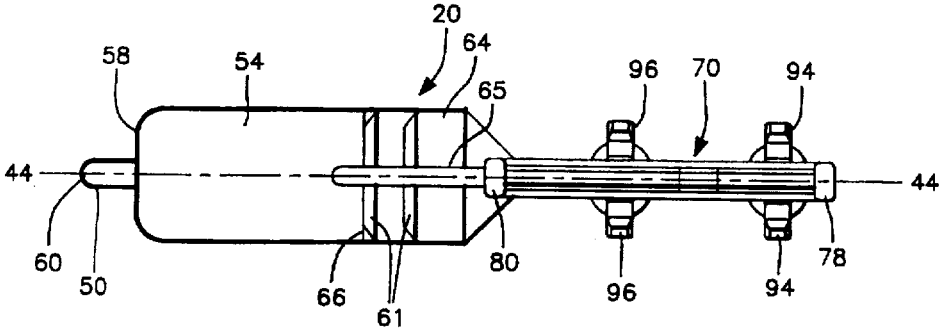
FIG. 2 is a top plan view of the display device of this invention.
Figure 3:
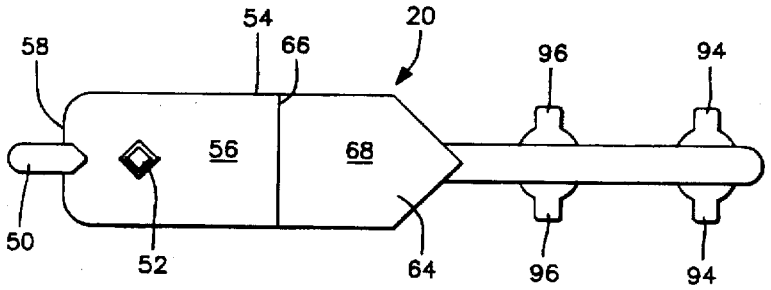
FIG. 3 is a bottom plan view thereof.
Figure 4:
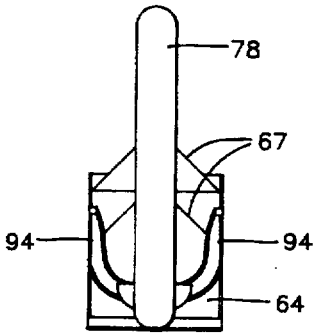
FIG. 4 is a front elevational view thereof.
Figure 5:
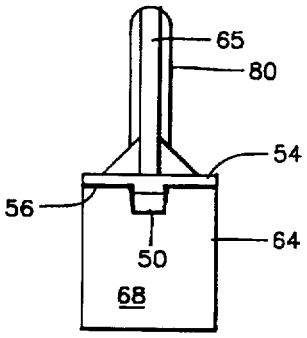
FIG. 5 is a rear elevational view thereof.
Figure 8:
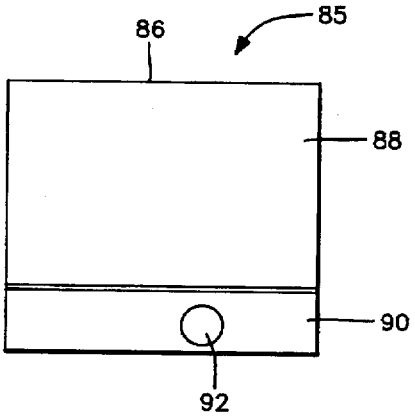
FIG. 8 is a side elevational view of a label cover adapted for use with the label holder when non-adhesive product labels are to be carried thereby.
Figure 9:
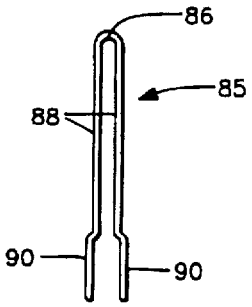
FIG. 9 is an end elevational view of the label cover.

If it is desired to display a non-adhesive product label or sign 26*a*, the display device 20 may be provided with a generally U-shaped label cover 85 as shown in FIGS. 8–10. The label holder 85 comprises a connecting portion 86 adapted to rest on the upper edge 72 of the label holder 70. Transparent panel members 88 depend from the connecting portion 86 and extend over each of the label-receiving surfaces 74 of the label holder 70 to define a pocket between each of the label-receiving surfaces 74 and its overlying panel member 88 for reception of a non-adhesive label 26*a*.

The lower ends of the label cover 85, below the transparent panel members 88, are offset as shown at 90 to overly the shoulders 76 of the label holder 70. An aperture 92 is provided in at least one, and preferably both, of the offset portions 90, and an aligned aperture 94 is provided in the shoulder 76 of the label holder 70 for reception of a push pin 95 to secure the label cover 70 in position after the non-adhesive labels 26*a* have been received in the aforementioned pockets.

The supporting portion 48 of the display device 20 further includes at least one, and preferably a pair of, upstanding hooks 94, 96 below the label-receiving surface 74 on each side of the label holder 70. Each of the hooks 94, 96 are adapted to receive and support, in depending fashion, a strip merchandiser such as those described hereinabove with reference to the aforementioned Fast patents. The nature of the strip merchandiser is not relevant to the instant inventive concepts, and different forms of strip merchandisers are shown 25 and 25*a*, respectively, in FIGS. 6 and 7, merely as illustrative.

The strip merchandiser 25 shown in FIG. 6 has the triple-finger locking mechanism 98 seen in several of the Fast patents, adapted to receive and hold blister-carded products 100 or the like in partially overlapping depending fashion. The modified strip merchandiser shown at 25*a* in FIG. 7 is of the clip-strip variety, and is particularly adapted to carry a plurality of snack products 102 or the like as shown illustratively in this Figure.

In either event, the strip merchandiser will generally include a mounting aperture at its upper end, adapted to be selectively received over one of the hooks 94 or 96, on each side of the display device 20. By providing at least two longitudinally-spaced hooks on each side of the label holder 70, a strip merchandiser may be selectively hung on the hook which is positioned as close to the front edge flange 36 of the shelf 28 as the width of the products carried by the strip merchandiser will permit. For example, in FIG. 6, where the blister-carded products are of a somewhat narrower width, the strip merchandisers 25 are hung on the inner hooks 96. In contrast, in FIG. 7, where the bags of snack products 102 are somewhat wider, the strip merchandisers 25*a* are hung on the outer hooks 94. By providing for selectively supporting the strip merchandisers as close as possible to the shelf, loss of aisle space is minimized, as is the likelihood that a passerby will accidentally engage the strip merchandiser, injuring the individual, or damaging the strip or the merchandise carried by the strip.

Figure 11:
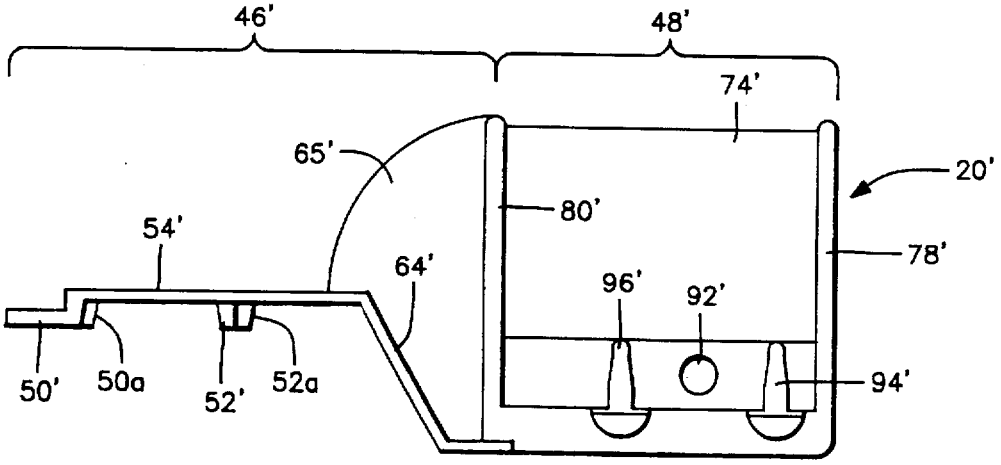
FIGS. 11 and 12 are a side elevational view and a perspective view respectively of a modified display device according to the invention.
Figure 12:
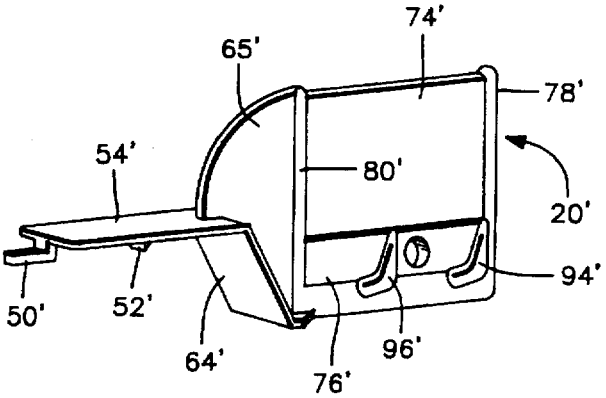

FIGS. 11 and 12 show a modified display device 20' according to the invention which is substantially similar to the display device 20 previously described and wherein, therefore, like reference numerals, with primes, are used to denote like parts.

One difference between display devices 20 and 20' is that in the case of display device 20', the spacing between the post 52' and the foot 50' (particularly the spacing between their front surfaces 52*a* and 50*a*) is twice the spacing between the equivalent post 52 and foot 50 in device 20. For example, the spacing between surfaces 52*a* and 50*a* may be 1" where as the equivalent spacing in device 20 may be only ½" This increase in spacing makes display device 20' somewhat more versatile than device 20 insofar as device 20' can be used on shelves where the spacing between the rows of apertures 38 is ½" (post 52' for example fitting in an aperture of the first row and foot 50' fitting in an aperture of the third row) and can also be used on shelves where the spacing between the rows of apertures 28 is 1" (post 52' for example fitting in an aperture of the first row and foot 50' fitting in an aperture in the second row). Display device 20 on the other hand cannot be used on shelves having the aperture rows spaced 1" apart.

Figure 13:
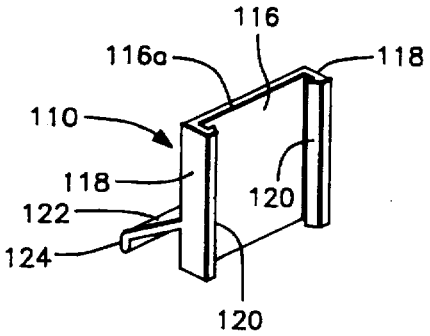
FIG. 13 is a perspective view of an attachable/detachable adaptor for display devices according to the invention which enables such devices to be used on shelves having different front edge surface configurations.

Another difference between display devices 20 and 20' is that device 20' is devoid of the strengthening ribs 67 used in device 20 in support of the transition member 64. Elimination of the ribs 67 enables device 20' to be fitted with a plastic adaptor 110 (FIG. 13) which allows the device 20' to be used on a shelf such as shelf 112 (FIG. 14) having a C-channel 114 along its forward edge rather than an angled surface 62. If, however, device 20' is to be used only on shelves having the angled front surface, the adaptor is not required and the ribs 67 may again be incorporated in the design of device 20'. In all other features, device 20' is alike to device 20.

Figure 14:
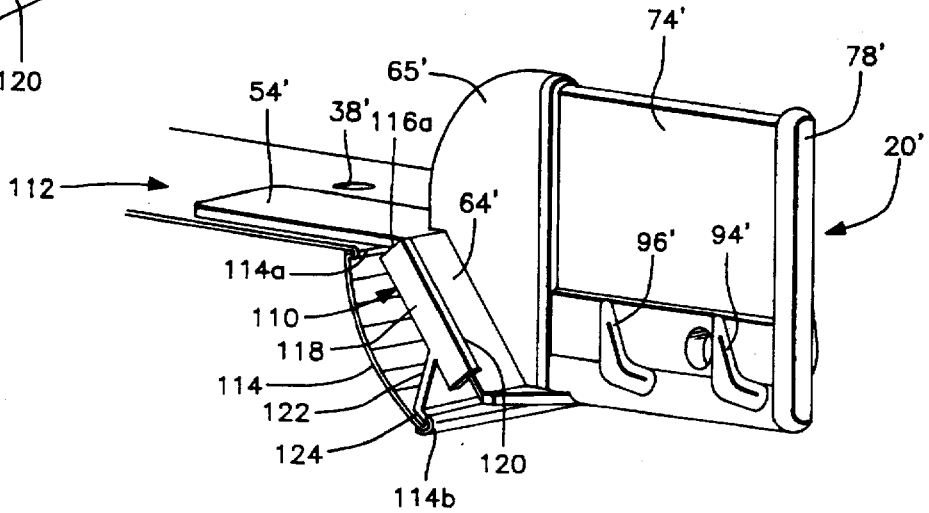
FIG. 14 is a perspective view of the adaptor attached to a display device and illustrating its manner of use on a shelf having a C-channel along the front edge.

Adaptor 110 comprises a channel-shaped main body with a base 116 and side walls 118 having internally bevelled edges 120. This construction allows the adaptor either to be snapped onto the transition member 64' of display device 20' or to slide on from one end, the walls 118, in either case, gripping the transmission member as shown in FIG. 14. Extending rearwardly from the base 116 the adaptor has an integral downwardly angled leg 122 terminating in a bent foot 124 with a radiused end.

The adaptor 110 is dimensioned so that when fitted to the display device 20' as described, the adaptor will press fit between the upper and lower lips 114*a*, 114*b* of C-channel 114 with foot 124 fitting behind the lower lip 114*b* and with the upper edge 116*a* of base 116 fitting against the upper lip 114*a*. This arrangement again provides stable cantilever support for display device 20' and for strip merchandisers suspended from hooks 94', 96'. If required, device 20' can also be used on a shelf, such as shelf 28 having an angled front surface, by detachment of adaptor 110.

In an alternative embodiment, not shown, the adaptor may simply comprise a channel-shaped body with an angled rear surface to conform against a shelf having a front edge surface at a different angle to the angle of transition member 64'.

Each of the elements forming the strip merchandisers and label holders of the instant invention may be made of any suitable material and manufactured by any conventional molding technique. However, they are most effectively injection molded, with the display devices 20, 20' being formed of polypropylene, the label cover 25 being formed of polyvinyl chloride, and the push pin 95 being formed of nylon.

It is believed that the use of the display devices of the instant invention is self-evident from the aforementioned detailed description of their construction, the manner in which the display devices are engaged with the shelves, and the manner in which product-carrying strip merchandisers and product labels are engaged with the display devices. From a consideration of the foregoing, it is seen that the objects of the instant invention outlined above, and other features and advantages hereof, are met.

While preferred embodiments of the instant invention have been described and illustrated herein, it will be clear that variations of the details of construction which are specifically shown and described, may be resorted to without departing from the true spirit and scope of the invention as defined in the appended claims.

I claim:

1. A plastic display device for supporting multiple strip merchandisers and product labels from a generally horizontally extending shelf having an upper and a lower surface and an elongated front edge, said display device including a forward end, a rearward end, an elongated central axis and further comprising:

a) a mounting portion at said rearward end adapted to removably secure said display device to the shelf with its central axis perpendicular to the front edge thereof;

b) a supporting portion at said forward end including i) an upstanding label holder extending along said central axis and having an upper edge and label-receiving surfaces on each side thereof, each of said label-receiving surfaces being adapted to receive and display a label containing product information, and ii) at least one upstanding hook below said label-receiving surface on each side of said label holder, each of said hooks being adapted to receive and support, in depending fashion, a product-carrying strip merchandiser;

c) a transition member connecting said supporting portion to said mounting portion, said transition member being adapted to provide cantilever support for the supporting portion against a front edge surface of a shelf having a first front edge surface configuration; and d) an adaptor attachable to and detachable from said transition member to provide, when attached, cantilever support for the supporting portion against a front edge surface of a shelf having a second front edge surface configuration.

2. The display device of claim 1 wherein the shelf includes a plurality of spaced apertures extending therethrough in rows parallel to the front edge thereof, said mounting portion of said display device including a base having a flat lower surface adapted to rest on the forwardmost portion of the upper surface of the shelf, a foot extending from the rearwardmost edge of said base along said central axis, said foot being parallel to, and spaced below, said base, a shoulder slightly larger than the thickness of the shelf between its upper and lower surfaces connecting said foot to said base, said foot being dimensioned to pass through an aperture in a row of apertures in the shelf other than a first row of apertures at the front edge of the shelf and including an upper surface adapted to be engaged against the lower surface of the shelf, and a post depending from said lower surface of said base along said central axis forwardly of said foot and adapted to be received in an aperture in the first row of apertures to stabilize said display device and preclude the same from swivelling about the engagement of said foot with the shelf.

3. The display device of claim 1 adapted to a shelf which includes a first front edge surface configuration having a front surface which extends downwardly and outwardly at an angle from the front edge of the shelf, wherein said transition member includes a substantially flat element with a lower surface extending downwardly and outwardly from said lower surface of said base at the same angle as the front surface of the front edge surface of the shelf, said lower surface of said transition member, with said adaptor detached, being adapted to rest on the front surface of the shelf, whereby said mounting portion of said display device is adapted to cantilever said supporting portion of said display device forwardly of the shelf.

4. The display device of claim 1 wherein said supporting portion includes at least two longitudinally-spaced hooks below said label-receiving surface on each side of said label holder whereby a strip merchandiser may be selectively hung on the hook on each side which is positioned as close to the shelf as the width of the products carried by the strip merchandiser will permit.

5. The display device of claim 1 wherein said label holder defines a shoulder beneath each of its label-receiving surfaces to facilitate positioning a product label thereon.

6. The display device of claim 1, further including a generally U-shaped label cover comprising a connecting portion adapted to rest on said upper edge of said label holder, and transparent panel members depending from said connecting portion and adapted to extend over each of said label-receiving surfaces of said label holder to thereby define a pocket between each of said label-receiving surfaces and its overlying panel member for reception of a non-adhesive product label on each side of said label holder.

7. The display device of claim 6, further including an aperture defined through said label holder below said label-receiving surfaces, an aligned aperture defined through the lower portions of at least one of said panel members of said label cover, and a push pin adapted to be engaged through said apertures of said label cover and said label holder to secure said label cover in position.

8. The display device of claim 3 wherein said adaptor comprises a channel-shaped main body member for fitting on said transition member selectively with a snap fit and a sliding fit.

9. The display device of claim 8 wherein the main body member comprises a base and side walls with upper inwardly bevelled edges for providing said snap fit and for gripping opposite edges of the transition member.

10. The display device of claim 8 wherein the main body of the adaptor includes a rearwardly extending downwardly angled leg terminating in a bent foot adapted to fit behind a lower lip of a C-channel forming said front edge surface of a shelf having a second front edge surface configuration, wherein the main body has an upper edge configured to fit under an upper lip of the C-channel whereby said adaptor when attached to said transition member provides cantilever support for the supporting portion of the device in the C-channel.

11. The display device of claim 3 in combination with a shelf having an angled front surface defining said first front surface configuration, said mounting portion being attached to the shelf and said transition member engaging said angled front surface to provide cantilever support for the supporting portion.

12. The display device of claim 10 with said adaptor attached to the transition member and in combination with a shelf having a C-channel front surface defining said second front surface configuration with said foot of the adaptor engaged behind a lower lip of the C-channel and said upper edge of the adopter fitted under an upper lip of the C-channel to provide cantilever support of the supporting portion.

* * * * *